United States Patent [19]

Cabourne

[11] Patent Number: 4,993,969

[45] Date of Patent: Feb. 19, 1991

[54] ELECTRICAL CONNECTOR ASSEMBLY

[75] Inventor: Michael K. Cabourne, Santa Ana, Calif.

[73] Assignee: Precision Interconnect Corporation, Portland, Oreg.

[21] Appl. No.: 378,079

[22] Filed: Jul. 11, 1989

[51] Int. Cl.[5] ..... H01R 9/07

[52] U.S. Cl. ..... 439/499; 439/498

[58] Field of Search ..... 439/445, 604, 492–499, 439/67, 77, 404–407, 55, 59, 65, 638

[56] References Cited

U.S. PATENT DOCUMENTS

| | | | |
|---|---|---|---|
| 3,966,295 | 6/1976 | Hyland et al. | 439/746 |
| 4,066,316 | 1/1978 | Rollings | 439/746 |
| 4,094,564 | 6/1978 | Cacolici | 339/14 L |
| 4,116,516 | 9/1978 | Griffin | 439/67 |
| 4,310,208 | 1/1982 | Webster et al. | 339/14 R |
| 4,327,956 | 5/1982 | Sitzler | 339/107 |
| 4,357,750 | 11/1982 | Ostman | 439/77 |
| 4,367,967 | 1/1983 | Albert, Jr. | 439/445 |
| 4,484,792 | 11/1984 | Tengler et al. | 339/143 R |
| 4,718,860 | 1/1988 | Gobets et al. | 439/494 |
| 4,750,266 | 6/1988 | Brandeau | 439/494 |
| 4,767,357 | 8/1988 | Hasircoglu | 439/499 |

*Primary Examiner*—David L. Pirlot

*Attorney, Agent, or Firm*—Chernoff, Vilhauer, McClung & Stenzel

[57] ABSTRACT

An electrical connector assembly for facilitating connection between interchangeable input/output cables and a high-density arrangement of traces on a circuit board inside a mainframe computer. The assembly comprises a collection of individual connector/terminal assemblies and individual flexible conductive elements, such assemblies and elements being specially formed and relationally positioned so as to optimize serviceability, high frequency performance, systematic routing capability and densifying capability.

30 Claims, 8 Drawing Sheets

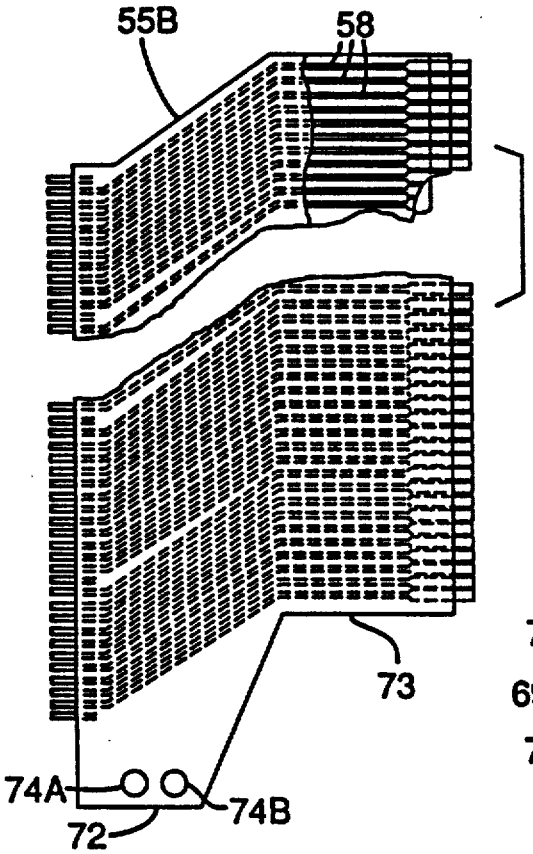
FIG. 5b
FIG. 5a
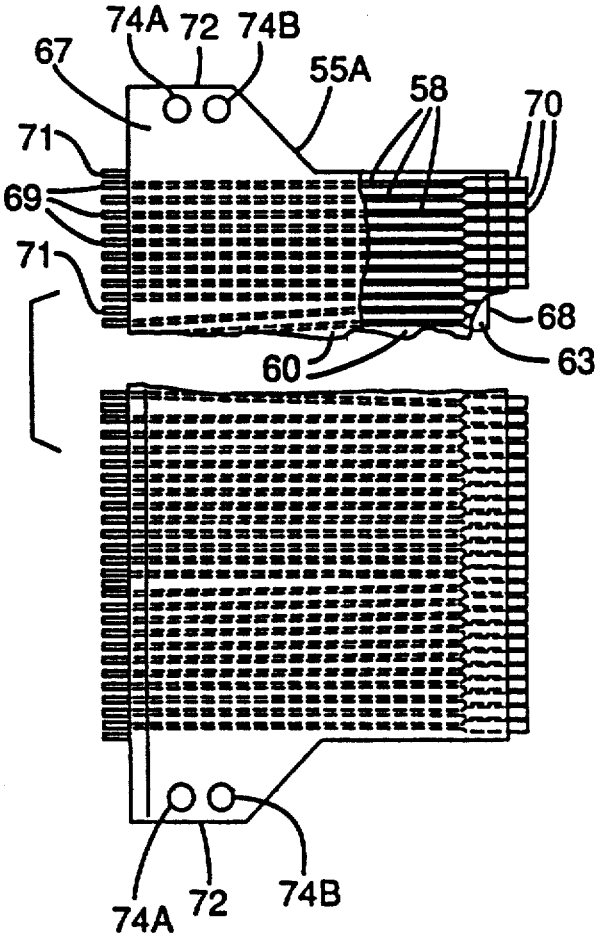
FIG. 5c
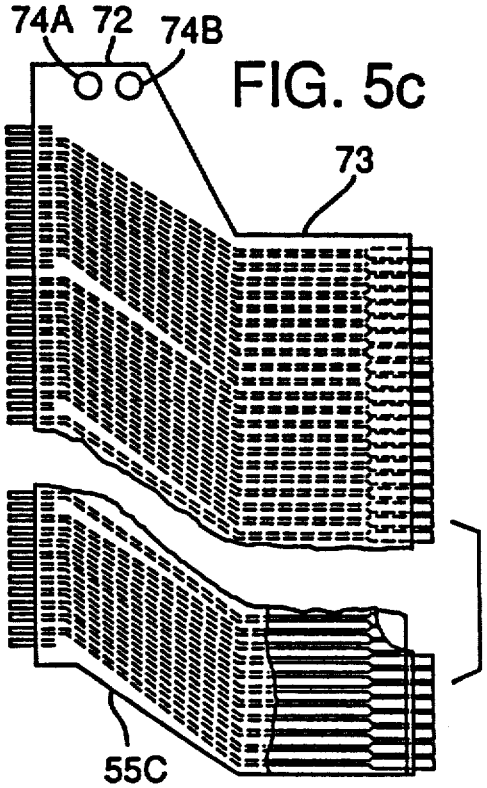

ELECTRICAL CONNECTOR ASSEMBLY

BACKGROUND OF THE INVENTION

The present invention relates to an electrical connector and, more particularly, to an electrical connector assembly especially useful for detachably engaging electrically with a high-density arrangement of interchangeable conductors and for systematically routing the resulting current to an even higher-density arrangement of indexed conductors.

Such an electrical connector assembly finds particular application in the area of computer mainframe connections where, for example, the indexed conductors represent a row(s) of conductive traces on a circuit board of a mainframe computer and where the interchangeable conductors represent coaxial or twisted wire cables leading to respective control panels, monitors, printing devices, or other input/output devices. In this type of exemplary environment, the critical features of an electrical connector array include its serviceability, its high frequency capability, its systematic routing capability, and its densifying capability. These features, in view of existing devices, will now be examined in turn.

At the detachably engaging end of the connector assembly is a contact array including discrete contacts typically requiring periodic serviceability. Such contacts may be forks, for example, each having a pair of tines that mechanically engages a respective pin-like terminal, as shown, for example, in Cacolici U.S. Pat. No. 4,094,564, Webster U.S. Pat. No. 4,310,208, and Sitzler U.S. Pat. No. 4,327,956. Such pin-like terminals may extend from a terminator block into which individual interchangeable conductors have been terminated. Such terminator blocks can be designed for separate insertion in, or removal from, the back of an insulative block contained inside the frame of a mating connector assembly as shown, for example, in Tengler et al., U.S. Pat. No. 4,484,792.

Occasionally, a connect/disconnect operation between a particular fork-like contact and a pin-like terminal of a particular terminator block will break or bend the fork or cause insulative material to be scraped from the separate insulative block surrounding all of the forks. This impairs the quality of the resulting electrical connection and makes connector serviceability down to the contact level highly desirable.

Ever increasing computer processing speeds have made the high frequency properties of the connector assembly critical. At increasing frequencies the conductors of the assembly function as antennaes and therefore they must be isolated from externally generated signals as well as from adjacent signal lines that would otherwise cause cross-talk. In addition, the electrical lengths associated with different contacts in the assembly cannot be so diverse as to cause significant delays among the high-frequency signals carried by the contact array.

The systematic routing capability of the electrical connector assembly is important because of the high number of signal lines associated with a mainframe computer. If a particular contact, in a particular position at the engaging end of the contact array, is always associated with a specific signal trace on a board inside the computer, then this prevents misconnection of external equipment. For example, there may be three discrete contacts that are unengaged but the user will be able to tell, by the respective positions of the unengaged contacts, which contact he should mate his desired interchangeable conductor with. Of course the user could test the computer output at each engaging contact to determine which contact he wants, but this requires much more time.

The densifying capability of the electrical connector array is especially important so that current may be routed from a high-density environment of the interchangeable conductors to an even higher-density environment of the indexed signal traces on the computer board. Although large scale integration (LSI) has vastly increased the computing power-to-size ratio of computer mainframes, the dimensioning capability of present day electrical connectors has not kept pace with this scale reduction in circuit technology, and the improved power-to-size ratio, to some extent, has been wasted.

Although attempts have been made to improve the densifying capability of electrical connectors, each attempt has lead to a commensurate, and unacceptable, reduction in serviceability, high frequency performance or systematic routing capability of the electrical connector. The first difficulty arises at the detachably engaging end of the contacts where the width of the mechanical tines on each discrete contact, although necessary to make each contact detachably engageable, sets a limit on how closely the contacts may be spaced together. When the widths of each tine are summed together the resulting sum is the maximum contact "footprint" measurable, for example, if the contacts were placed on a level surface, side-by-side, touching each other. Generally, from each discrete contact extends a terminal, such terminal including a neck portion and a lead portion, whereupon the lead portions of all of the terminals together form a coplanar layer. The primary difficulty arises in minimizing the spacing between respective leads and minimizing total contact footprint without degrading high frequency performance. For example, the required lead spacing may be achieved solely by the use of bends in the terminal necks, but this does nothing to reduce the maximum contact footprint. Such an approach also results in each adjacent contact-/neck/lead assembly having its own unique physical shape and electrical length, thereby greatly increasing manufacturer tooling costs and degrading high frequency performance. By vertically overlapping adjacent contacts one may reduce the total contact footprint, and decrease the lead spacing as well, but each assembly still has a unique physical shape and electrical length. Furthermore, at high frequencies, the wide conductive surfaces of the contacts will tend to capacitively couple thereby inducing cross-talk between adjacent signal conducting contacts. A conventional approach, that does improve densifying capability, while also addressing high tooling cost and degraded high frequency performance, is a division of the contacts into a top and bottom group, where a straight neck portion extending upwardly from a bottom contact is followed by a straight neck portion, of equal length, extending downwardly from a top contact and vice versa. Each contact/neck/lead assembly may then have the same physical shape and electrical length, greatly decreasing tooling costs and improving high frequency performance, Additionally, capacitive coupling will be improved over the vertically overlapping aproach because, given a lead spacing equalling half the connector width, for example, the flat surfaces of the contacts will be arranged in side-by-side, rather than in overlapping, relationship. With this approach, however, the contact footprint will approach, but never be less than, half the maximum contact footprint. Additionally, if the necks are bent to further reduce lead spacing (otherwise the use of straight necks sets the minimum lead spacing at one-half the width of each contact) then the contact-/neck/lead combinations will no longer have equal physical shape thereby reestablishing increased tooling costs.

In addition to the limiting factors just discussed, the minimum lead spacing obtainable will be determined by the size of the leads themselves and by cross-talk requirements. If the widths of the leads are reduced, without reducing the spacing between each respective lead, this reduces cross-talk between adjacent signal conducting leads but makes each individual lead susceptible to breakage or to being bent out of position (thus destroying systematic routing capability or creating signal shorts). Although the dimensional gap, between the narrow semirigid leads and the even narrower indexed conductors, may be made using thin insulative wires (that are less susceptible to breakage because of the cushioning effect of the insulation) such discrete wires are easily mispositioned (non-systematically routed) therefore creating excessive assembly errors. Another possible means of bridging the dimensional gap is to use ribbon cable. This eliminates systematic routing problems because of the ordered arrangement of the ribbon conductors. However, the ribbon conductors may only be made so thin before problems are encountered, such as breakage of the conductors when the ribbon cable is stripped or such as breakage of the conductors when the ribbon conductor-to-lead connection is moved slightly due to connector insertion forces.

SUMMARY OF THE PRESENT INVENTION

Accordingly, an object of the present invention is to provide a detachably engageable connector array that compatibly features serviceability, systematic routing capability, high frequency capability and an enhanced densifying capability particularly in regard to the minimization of contact footprint and the minimization of lead spacing.

A further object of the present invention is to provide a means of bridging the dimensional gap between a dense arrangement of coplanar, substantially nondeformable leads and a dense arrangement of narrower indexed conductors such as found on a circuit board utilizing large scale integration (LSI) technology.

A first aspect of the present invention is an arrangement of contact/terminal assemblies where the contacts are not only divided into top and bottom groups but they also each occupy a unique vertical position. As contrasted with an arrangement relying solely on top/-bottom groups, this approach permits the total contact foorprint to be reduced below half the maximum contact footprint and the minimum lead spacing may be brought well below one-half the width of each contact (even where straight neck portions are used for minimum tooling). Additionally, reduced high frequency coupling will occur between closely adjacent signal conducting contacts. As contrasted with an approach relying solely on vertical overlapping of contacts, this approach permits improved high frequency performance where assembly pairs having equal electrical length are used or where twice the lead distance is provided, for a given lead spacing, between closely overlapped signal conducting contacts.

A second aspect of the present invention relates to an arrangement of contact/terminal assemblies utilizing not only top/bottom groups and vertical offsets but also symmetry considerations. Specifically, by arranging the contacts (keeping in mind footprint minimization as well as cross-talk minimization or impedance normalization) so that for each contact /terminal assembly above the coplanar leads there is a symmetrical contact-/terminal assembly below the coplanar leads, assembly pairs having equivalent physical shape and electrical length are obtained, thereby reducing tooling costs and equalizing high frequency delay times among pairs. Uniform spacing between terminal leads, and use of L-shaped structures, then permits either minimization of cross-talk levels, where each terminal is signal conducting, of normalization of impedance characteristics, where alternate terminals are signal conducting and the remaining terminals maintain reference potential. Alternatively, or in conjunction, each assembly may be adjusted in length so as to equalize high frequency delay times among all of the assemblies. Large connector insertion forces are provided for through equally sized tines on each contact that distribute the applied pressure evenly and by resilient latching tangs on each contact that hold a group of forks in a respective insulator block despite the opposing pressure. In turn, this prevents large-scale movement of flex circuit conductors connectable to the terminals as described hereafter.

A third aspect of the present invention combines the use of vertical offsets and electrical length compensation for contact/terminal assemblies not necessarily symmetrical with each other but that do each share the same minimum contact width. Permitting each contact only enough width for reliable detachable engagement results in minimum contact footprint and capacitive coupling. To compensate for electrical lengths, the greater the vertical displacement required from each contact to its respective lead the less the horizontal displacement provided from that same contact to that same lead. This optimizes high frequency performance and further permits minimization of the contact footprint when the contacts are placed in overlapping relationship. The faces of two contacts that are associated with two adjacent signal conducting leads may be directed away from each other to minimize capacitive coupling. A refinement of this is to employ top/bottom groups where the two contacts vertically closest to the leads are the contacts that are oppositely directed. An important feature is the prescription of a specified ordering sequence where the top contacts, in sequence,-.are followed by the bottom contacts, in sequence (as opposed to the top sequence being interposed with the bottom sequence) that enables the smallest achieveable lead spacing for the specified structure.

A fourth aspect of the present invention is utilization of a flex circuit that is specially configured for bridging the dimensional gap between the dense arrangement of coplanar leads and the dense arrangement of narrower indexed conductors. Specifically, the flex circuit is relatively rigid to permit small-scale movements (for example, when the contact array is engaged) but at the same time to protect against large-scale movements that might break the very thin flex conductors residing in the flex circuit. To prevent breakage at the second end of the flex circuit, where the flex conductors actually attach to the coplanar leads, the flex conductors are made relatively thick relative to their thickness at the first end of the flex circuit, where they attach to the narrower indexed conductors.

To prevent breakage at the first end of the flex circuit, where the flex conductors are very thin wires attaching to a dense arrangement of very narrow indexed conductors, the invention relies on the cushioning effect of the insulation surrounding the conductors, as well as on a semi-rigid supporting base (preferably a conductive sheet) that is fixed relative to the indexed conductors (through reference lead ends). This semi-rigid supportive base prevents small-scale physical movements, at the coplanar lead end, from being transmitted to the indexed conductor end. The base may also be a conductive sheet thus establishing well-defined electrical regions around each flex conductor. Not only can the flex conductors be varied in dimension along their length, but the lead spacing between these conductors can be very precisely controlled by using a photolithographic process to etch the flex conductors. As was true with the terminal leads, uniform spacing between the flex conductors promotes either cross-talk minimization or impedance normalization. Similarly, the controlled order of the flex conductors facilitates a rapid simultaneous connection step at both ends thereof without the need for expensive indexing equipment.

A fifth aspect of the present invention is the manner in which it resolves the requirement of periodic connector serviceability with the requirement of systematic routing by providing a modular assembly of disposable flex circuits. Specifically, at least two individual flex circuits are positioned in face-to-face relationship, releasably adjoined at one end, and vertically separated at the other end for eventual connection to at least two vertically separated groups of coplanar leads contained in one or more insulator blocks. Each group of coplanar leads preferably carries a group of related signals. When the user detects signal errors for a particular group of coplanar leads, the related flex circuit may then be released from the other flex circuits and disposed of, along with the accompanying engageable contacts and, in some cases, a suspect insulator block. A specific embodiment of the invention uses back-to-back conductive sheets to prevent flex conductor breakage and to provide well-defined electrical regions having controlled impedances. At the ends of the flex circuits, cross-talk between adjacent signal bearing flex conductors is minimized by either alternating each top flex conductor with a bottom flex conductor or by extending the top conductive shield beyond the ends of all the bottom flex conductors as more specifically described hereafter. The latter approach has the further advantage of doubling the densifying capability of the contact array.

A sixth aspect of the present invention is similar to the fifth aspect except that individual flex circuits are horizontally separated at their separated ends. These separated ends are electrically routed through to at least two horizontally separated insulator blocks. In particular, a specific embodiment is disclosed that is routable to any number of horizontally separated insulator blocks with the use of only three manufacturable varieties of flexible circuits, thereby promoting exchangeability of the flexible circuits. Further features of the invention include an overlapping relationship between releasably adjoined flexible circuits, so as to ensure minimum flex conductor spacing, and a designation system where flexible conductors designated for signal connection are separated by flexible conductors designated for reference connection, thereby largely minimizing cross-talk between adjacent flexible conductors.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIGS. 5*a*, 5*b* and 5*c* are elevational plan views, respectively, of three types of flexible conductive elements in accordance with the present invention.

DETAILED DESCRIPTION OF THE INVENTION

Figure 1:
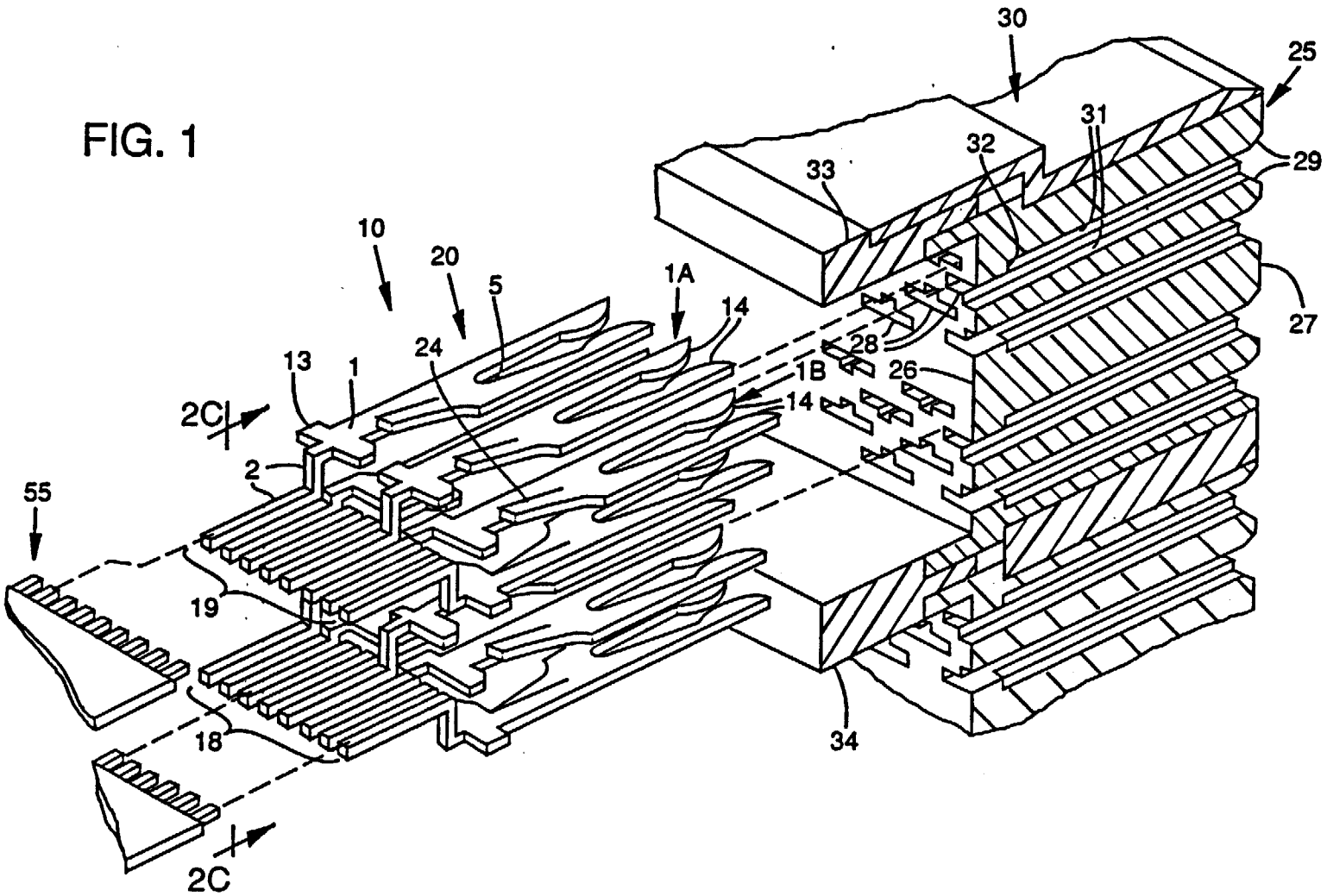
FIG. 1 is an exploded perspective view of an exemplary embodiment of an electrical connector assembly in accordance with the present invention.
Figure 3A:
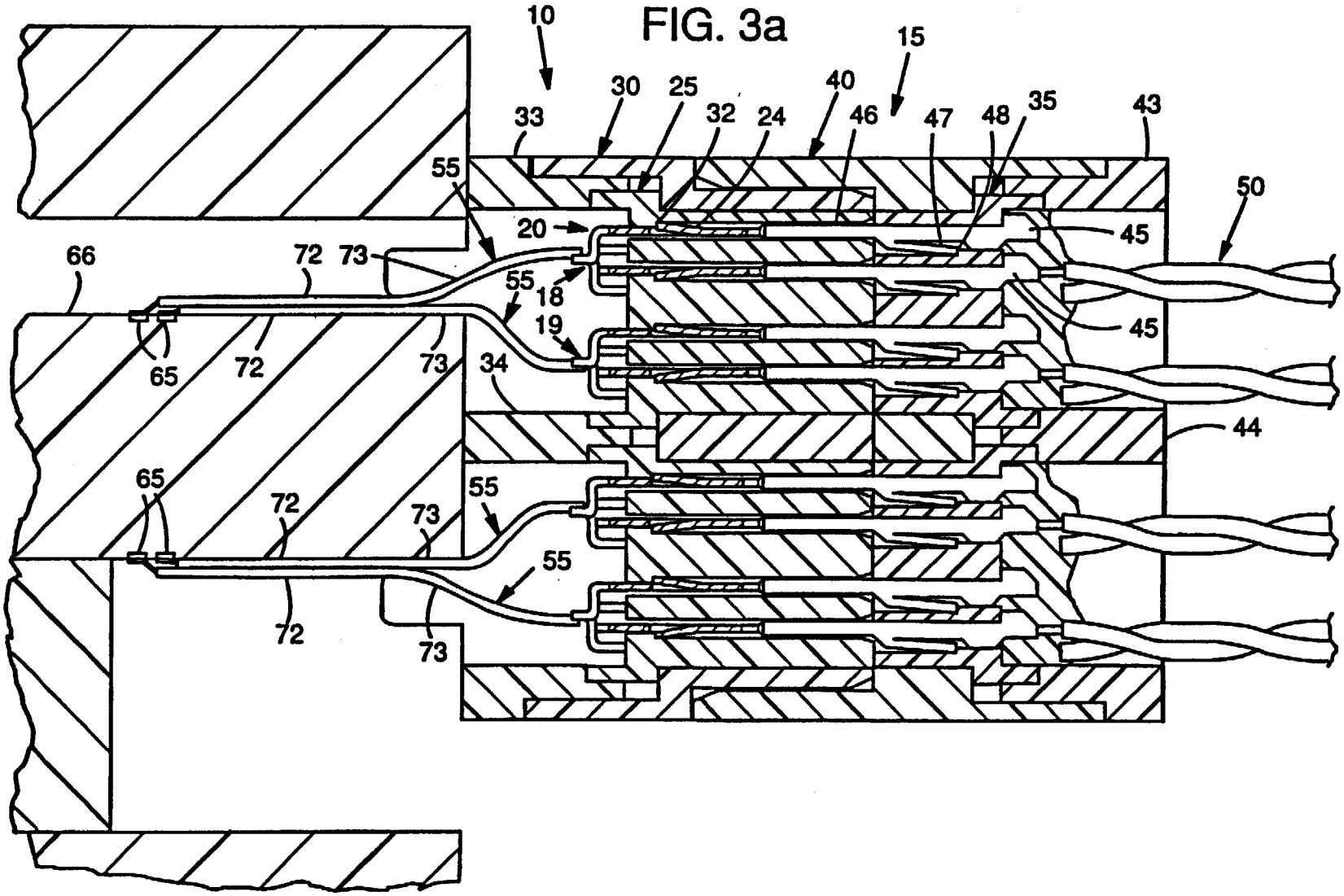
FIG. 3*a* is a side sectional view, taken along line 3*a*—3*a* of FIG. 2*c*, including depiction of a mating multiconductor assembly detachably engageable with the exemplary embodiment of the electrical connector assembly, and further depicting the indexed traces and interchangeable conductors between which such electrical connector assembly operates.
Figure 8:
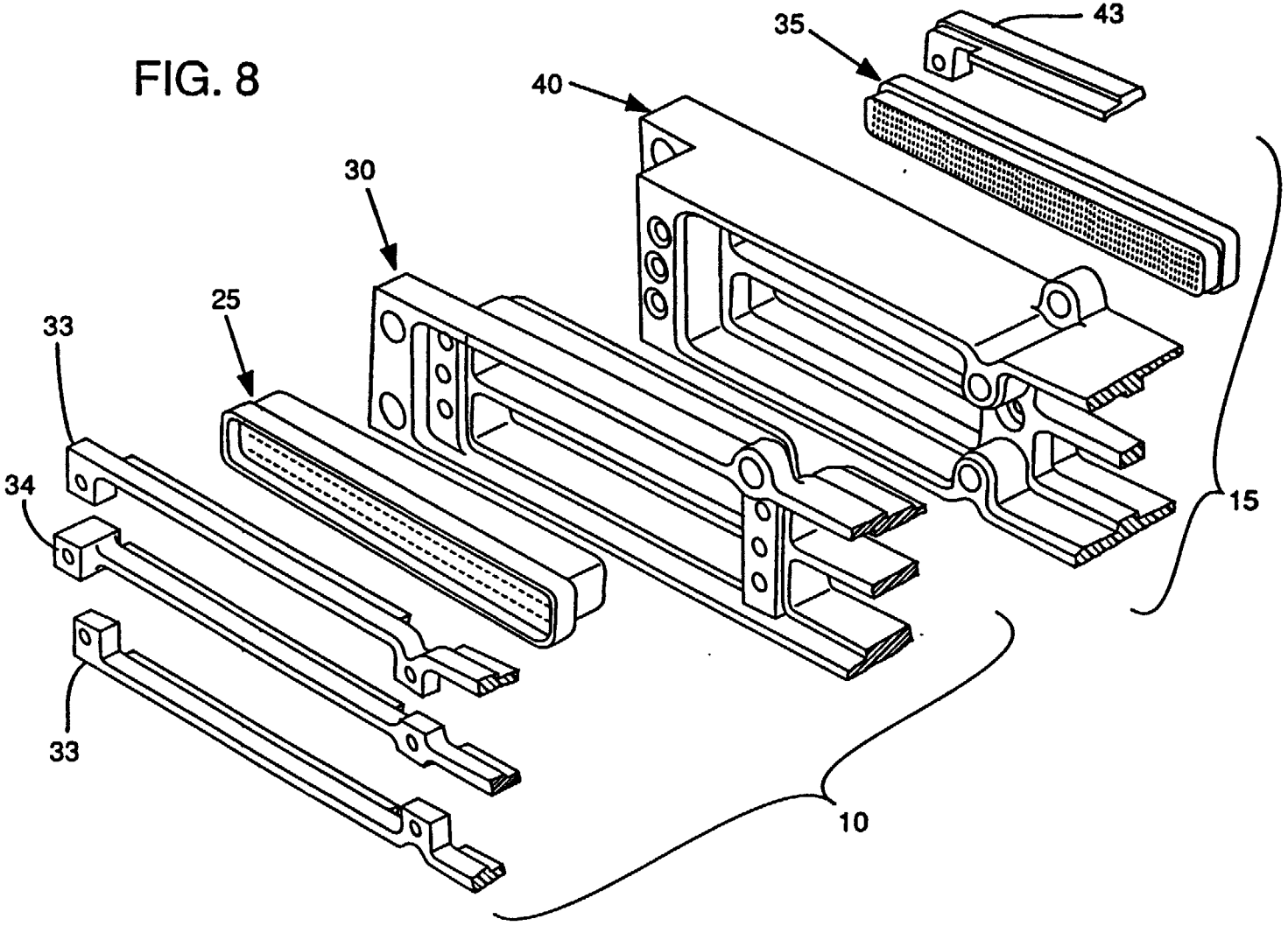
FIG. 8 is an exploded perspective view of an exemplary frame and associated elements suitable for use in conjunction with an electrical connector assembly and mating multiconductor assembly as envisioned by the present invention.

FIGS. 1 and 3*a* show an exemplary electrical connector assembly 10 constructed in accordance with the present invention and suitable for establishing connection between a printed circuit board inside a mainframe computer and individual input/output lines that route to individual input/output devices. Specifically, electrical assembly 10 is comprised of at least one flexible conductive element 55, a contact array 20, at least one insulator block 25, and preferably a frame 30. Referring to FIG. 8, the electrical connector assembly 10 may be made detachably engageable with a mating multiconductor assembly 15. Engagement may occur when the frame 40 of the mating multiconductor assembly is slid over the frame 30 of the electrical assembly thereby bringing the insulator block 35 for the mating assembly into contact with the insulator block 25 for the electrical connector assembly. The insulator block 25 for the electrical connector assembly may be held to the frame 30 due to the wedging action of an outside keeper 33 and a central keeper 34 which are screwed to the connector frame 30. In a similar way, the insulator block 35 for the mating assembly may be held to the frame 40 by outside keeper 43 and a central keeper.

Again referring to FIGS. 1 and 3*a*, the interchangeable conductor 50 feeding to a particular input/output device is represented by a twisted wire pair that connects with a pair of terminator blocks 45 from which extend a pair of pin-like terminals 46. When the electrical assembly 10 and mating connector assembly 15 are engaged, that is, when an insulator block 25 of the electrical connector assembly and an insulator block 35 of the mating assembly are brought together, the pair of pin-like terminals 46 will slide between the opposed tines 14 of a pair of contacts 1A and 1B, each contact being of a fork-like structure. As shown in FIG. 1, each cavity 28 of an insulator block 25 is provided with inwardly converging beveled walls 29 at the second side 27 of the insulator block to facilitate passage of a pin-like terminal into that respective cavity and into a respective pair of opposed tines. The detachably engageable portion 5 of the contact 1 lays along the middle of the fork-like structure where the pin-like terminal actually establishes electrical connection with the contact. More generally, the detachably engageable portion of a contact envisioned by the present invention need not be limited to a fork-like structure, as shown in the drawings, but may be a socket, an optical fiber, or any other device capable of communicating electromagnetically with a detachably engageable mating terminal.

Figure 2A:
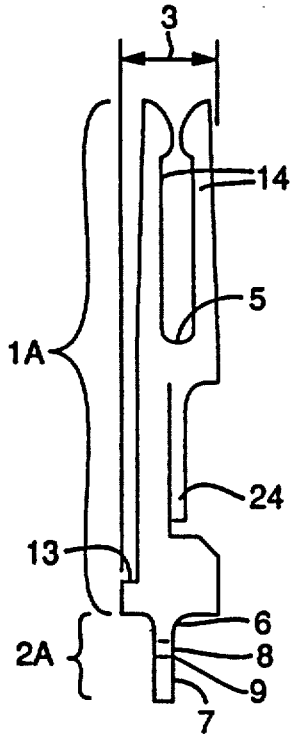
FIG. 2*a* is a plan view of one type of contact/terminal assembly, before forming, in accord with the present invention.
Figure 2B:
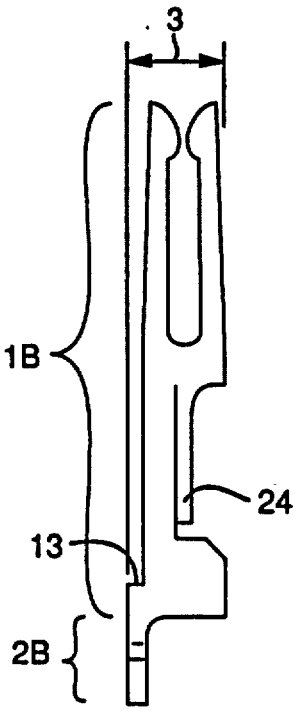
FIG. 2*b* is a plan view of a second type of contact-/terminal assembly, before forming, in accord with the present invention.
Figure 2C:
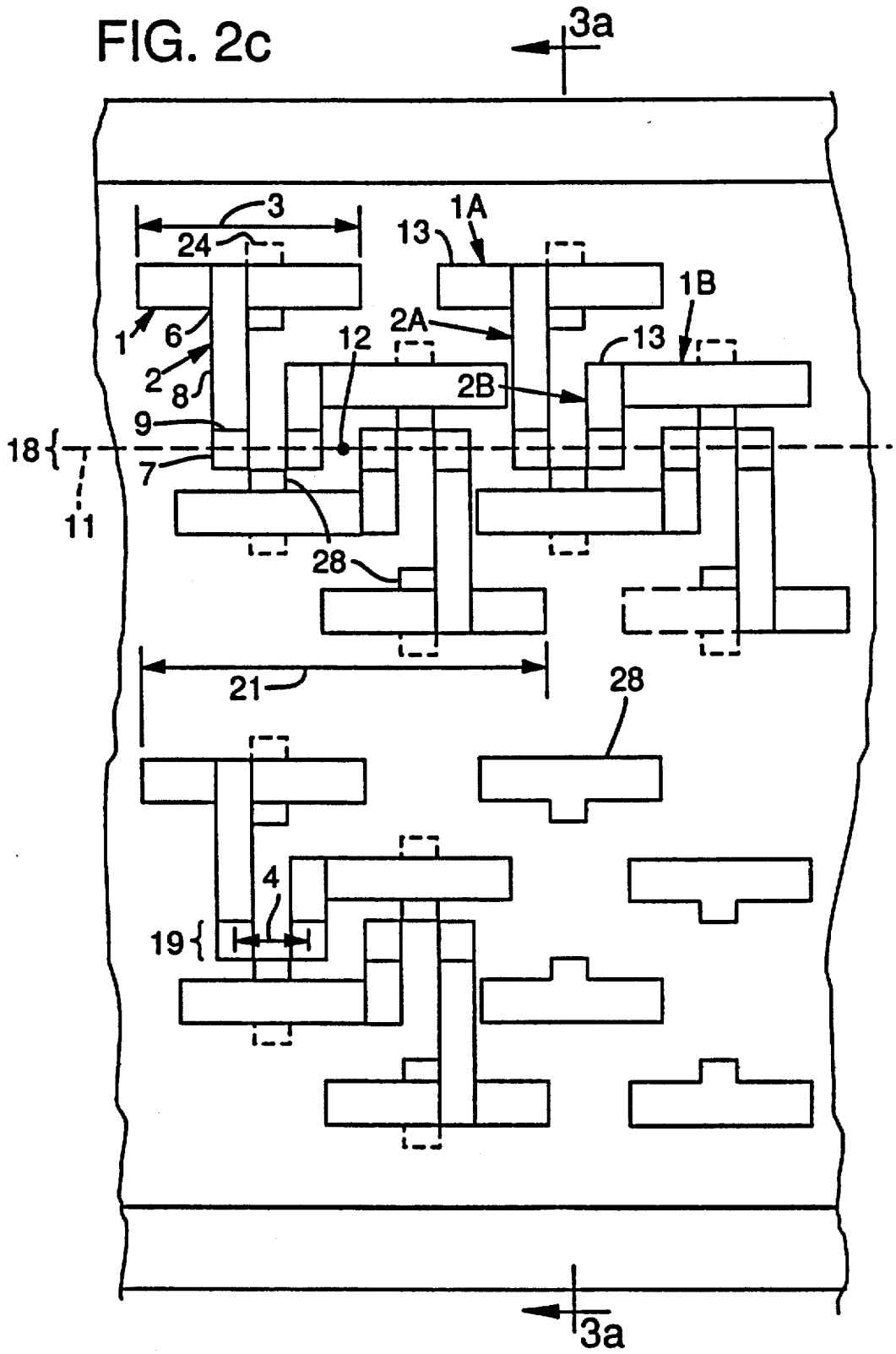
FIG. 2*c* is an enlarged view taken along line 2*c*—2*c* of FIG. 1.

In FIG. 1, the electrical contact array 20 is comprised of 16 individual contact/terminal assemblies. One type of such individual contact terminal is shown in FIG. 2*a*. The contact portion 1A of the assembly includes a detachably engageable portion 5 and a coupling portion 6. The terminal portion 2A of the assembly includes a neck portion 8 and a lead portion 7 with a juncture 9 being shared between the neck and lead portions. Refer also to FIG. 2*c*. It will be recognized that to be detachably engageable the contact must have a certain dimension from side-to-side. For example, with the specific embodiment shown, unless the opposed tines 14 are of a certain width, they will break upon insertion of the pin and the contact will not be detachably engageable. Of course, the width of the contact cannot be made too great, or else it will be impossible to achieve the very high-density packing required of the electrical connector assembly. The appropriate predetermined maximum dimension 3, using pin-like terminals of 10 mil across, has been found to be about 60 mil. The terminal portion 2A of the contact/terminal assembly may be made about 10 mil across while still retaining the rigidity needed to maintain its relative placement without bending or breaking thereby preserving the systematic routing capability of the electrical connector assembly. During manufacture, each individual contact/terminal assembly may be etched, or stamped, from a sheet of beryllium copper having a thickness of 10 mils. The individual pieces may be formed, and plated with nickle, using a simultaneous method employing a carrier strip processing technique as is conventionally known in the art. If desired, the detachably engageable portion may be gold plated to a thickness of at least 0.05 mil.

During operation, each individual contact/terminal assembly is held in a cavity 28 of the insulator block 25 by a resilient latching tang 24. As best depicted in FIG. 1, when an individual contact 1A or 1B is inserted from the first side 26 of the insulator block into a respective cavity 28, the resilient latching tang 24 will be depressed until the interior shoulder 32 of the cavity is encountered, at which time the resilient latching tang 24 will extend upward and rest against the interior shoulder. A stop portion 13 on the individual contact/terminal assembly prevents the contact from moving further into the cavity. See also FIGS. 2*a* and 2*b*. Delatch channels 31 are provided in the cavities 28 of the insulator block 25 so that an insertion tool may be extended into the cavity containing the assembly, whereupon the resilient latching tang may be depressed to a flattened position that is level with the contact surface and the individual contact/terminal assembly removed from the insulator block 25. Similarly, terminator blocks 45 may each be provided with a latching tang 47 that releasably locks to interior shoulder 48 of insulator block 35 that is part of mating assembly 15. See FIG. 3*a*. The latching tangs serve to counteract the insertion forces present when a group of pins are inserted into a group of contacts.

An important inventive aspect of the electrical assembly 10 is the electrical contact array 20 and, in particular,.the special configuration of the individual contact-/terminal assemblies with respect to one another. Referring to FIG. 2*c* it will be recognized that the contact-/terminal assemblies are arranged to form coplanar contact lead groups along imaginary line 11. In the particular embodiment shown in FIGS. 1 2*c* each insulator block 25 has a first series 18 and a second series 19 of such coplanar contact lead groups. The number of coplanar contact lead groups may be increased pursuant to design requirements and commensurate with an increase in the number of flexible conductive elements 55. See FIG. 1. The specific r embodiment shown in FIG. 2*c* reveals how a basic set of contact/terminal assemblies, in this instance having four individual assemblies per set, is repeated at uniform intervals to provide a coplanar contact lead group. Within each basic set, each of the contacts occupies a unique vertical position with two (half) of the contacts being positioned above the coplanar lead group and two (half) of the contacts being positioned below the coplanar contact lead group. These techniques, of unique vertical contact positioning and of equally divided top/bottom contact grouping, operate together to facilitate closer spacing between individual lead portions 7 than would be possible with either technique alone. In particular, the lead spacing 4, here 20 mil, can be made smaller than the predetermined maximum dimension 3, here about 60 mil, required to make each connector detachably engageable. While the same lead and vertical contact spacing, with the same predetermined maximum dimension, can be obtained for a basic set by using unique vertical positioning alone, such technique used alone would degrade high frequency performance, because of increased electrical length disparity among assemblies and because of increased cross-talk when each flat contact is signal conducting. Depending on where the neek portions are attached, some reduction in cross-talk is achievable with vertical overlapping, but an increase in total contact footprint 21 for the basic set would then result, thereby reducing overall densifying capability. Using top/bottom grouping alone, the closest achieveable lead spacing would be 30 mil assuming the use of assemblies having straight neck portions 8 and given the 60 mil value for the predetermined maximum dimension. Whether four assemblies are used per basic set, or greater than four assemblies are used per basic set, the two aforementioned techniques, in combination, enhance the densifying capability of the electrical connector without undue reduction in high frequency capability.

In FIG. 2*c*, the ordering of assemblies shown is one where the two top assemblies are followed by the two bottom assemblies. An alternative ordering is possible, however, where a top assembly is followed by bottom assembly in turn followed by a top assembly and thereafter a bottom assembly. For example, the two assemblies having contacts 1B, which extend closest to the coplanar leads 11, may be imagined as shifted across each other so that their lead portions 7 are exchanged in position. The illustrated ordering is preferable, however, for the particular shape of assemblies shown in FIG. 2*c*, because, for the given lead spacing 4, an alternating order would increase the total contact footprint 21. More generally, the minimum total contact footprint, for a given lead spacing, will be provided by this ordering arrangement if the contact/terminal assemblies are symmetrical, if partial compensation is made for electrical length (as explained hereafter), and if all the contacts have identical widths 3 and all the assemblies are L-shaped structures having no overlapping portions (such as the stop portion 13 shown in FIG. 2*a*).

In FIG. 2*c* it will be seen that lead spacing 4 is uniform between each pair of lead portions 7. This ensures, for a given available total lead spacing, either cross-talk minimization among signal conducting leads or impedance normalization where the leads alternately provide signal or reference potential. For the specific embodiment described herein, the lead spacing 4 is about 20 mil. In FIG. 2*c* it will also be seen that the vertical spacing between closely adjacent contacts is kept substantially uniform thereby decreasing cross-talk, where each contact is signal conducting, or normalizing impedance, where the contacts alternate between signal and reference potential. For the embodiment described, this vertical spacing ranges from 25 mil to 30 mil. Although the assemblies depicted are substantially L-shaped, the invention encompasses the use of assemblies that are T-shaped, which have slanting or curved terminals 2, or which have curved contacts 1. Whatever shape is utilized, however, it is advantageous to symmetrically arrange the assemblies to acquire the top and bottom groups. For example, the basic set of four assemblies shown in FIG. 2*c* utilizes only two types of assembly: a first type of contact/terminal assembly shown in FIG. 2*a* and a second type of contact/terminal assembly shown in FIG. 2*b*. Each assembly comprises a contact, 1A or 1B, and a terminal 2A or 2B. From FIG. 2*c*, it will be seen that the individual assemblies comprising the bottom group are equivalent to the individual assemblies comprising the top group, being only in translated position about a predetermined axis of rotation 12 through the imaginary line 11 defined by the coplanar lead groups. Use of symmetrical assemblies reduces tooling costs, electrical length disparity and eliminates orientation considerations at assembly. In the embodiment shown in FIG. 2*c*, if the first type of assembly is used exclusively for signal lines and the second type of assembly is used exclusively for ground lines, high frequency delay times among the signals will be equalized. More generally, the idea of symmetrical assemblies may be expanded to encompass any number of types of assemblies. The symmetrical assemblies are preferably provided with straight terminals 2A and 2B, and flat contacts 1A and 1B, for this minimizes cross-talk among signal conducting assemblies and minimizes precision bending during manufacture. Such design provides the assemblies with their characteristic L-shape when viewed from behind as in FIG. 2*c*. It is preferable, although not required to practice this aspect of the invention, that the width 3 for each symmetrically different type of contact, 1A or 1B in this instance, be made uniformly small so as to ensure minimum capacitive coupling between each type when each contact is signal conducting.

Recognizing that the distance between the detachably engageable portion 5 of the contact and the juncture 9 of the terminal establishes the electrical length of the assembly, partial compensation may be made for the varying electrical lengths between different types of assemblies. For example, although the first type of assembly shown in FIG. 2*a*, in contrast to the second type of assembly shown in FIG. 2*b*, has a greater vertical distance (first offset) between its detachably engageable portion 5 and juncture 9, it also has a lesser horizontal distance (second offset) between its detachably engageable portion 5 and juncture 9. Refer to FIG. 2*c*. Such an approach reduces delay times among signals at high frequencies. A further refinement is to decrease high frequency capacitive coupling, among contacts that belong to an adjacent pair of assemblies, by horizontally extending the first respective contact 1, of the pair, from its juncture 7, in a direction opposite to the horizontal extension of the second respective contact 1, of the pair, from its juncture 7. This configuration is illustrated in FIG. 2*c*, between that pair of assemblies being both of the second type (FIG. 2*b*). This pair also has their contacts extending in opposite vertical directions from each other but, more generally, it is ufficient to fall within the ambit of the present invention that the connectors extend in opposite directions only horizontally.

In addition to the special configuration of the electrical contact array 20, a further important aspect of the present invention is the deployment of flexible conductive elements 55 to bridge the gap between the high-density coplanar lead groups and the high-density, but narrower, coplanar conductive traces 65 on the planar dielectric circuit board 66 mountable inside a mainframe computer. Refer to FIG. 3*a*. In FIG. 5*a*, the flexible conductive elements 55A, 55B and 55C are representative of a flexible conductive element 55 in accord with the present invention. As stated above, the lead portions 7 of the contact/terminal assemblies may be made 10 mil across and still retain their systematic routing capability. Also, as stated above, the spacing 4 between adjacent leads may be made 20 mil across. Connection to such high-density coplanar leads is accomplished by a high-density arrangement of planar conductive strips 58 as shown on the conductive element 55A of FIG. 5. Each conductive strip 58 has a flexible lead end 69 extending from the first end 67 of the conductive element and a flexible lead end 70 extending from the second end 68 of the flexible conductive element. To facilitate connection with the narrow indexed conductors 65 on the dielectric board 66 the flexible lead ends 69 may each be designed to have a width of 4 mil across and a spacing between each other of about 20 mil. This narrow width of the flexible lead ends 69 further ensures cross-talk minimization among the conductive strips 58 when they are each signal conducting and ensures room for the reference lead ends 71 which periodically extend from a semi-rigid supporting sheet 63 having a function described below. At the second end 68 of the flexible conductive element 55A the flexible lead ends 70 are made relatively wider, for example about 10 mil, to prevent breakage of such ends during small-scale movement of the coplanar lead groups. The spacing between the flexible lead ends 70 should correspond to the spacing between the lead portions 7 of a coplanar lead group 11, for example may be made 20 mil across. The conductive strips 58 are encased within a flexible insulative covering 60 and bonded to a semi-rigid supporting sheet 63.

Figure 6A:
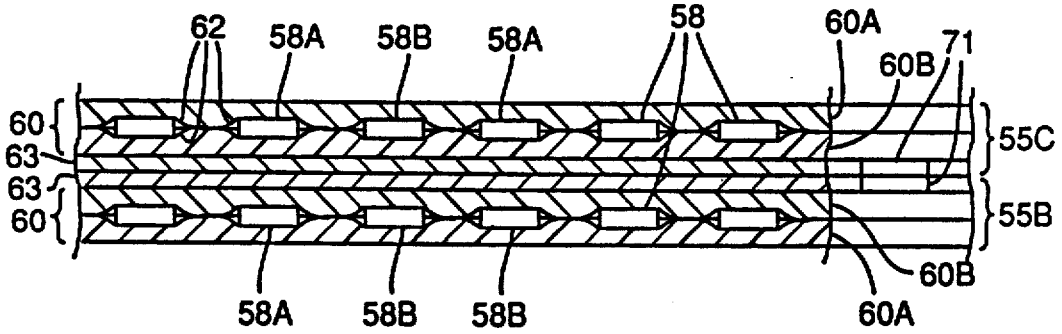
FIG. 6*a* is an enlarged cross sectional view, taken along line 6*a*—6*a* of FIG. 4, of one embodiment of two joined flexible conductive elements in accordance with the present invention.

During manufacture, the conductive strips are etched from a sheet of Elecrical Tough Pitch (ETP) copper so that the thickness of the leads at the first end 67 are approximately 1.5 mil while the thickness of the leads at the other end 68 are approximately 3 mil. It is highly desirable, when etching the conductive strips 58, to leave a pair of carrier strips remaining, so that one strip remains connected to all of the flexible leads 69 and another strip remains connected to all of the flexible leads 70. This preserves the uniform spacing between the conductive strips as the strips are being encased in a flexible insulated covering 60 and being mounted on a semi-rigid supporting sheet 63. As was true with the lead portion 7 of the contact/terminal assemblies, uniform spacing between the conductive strips 58 either minimizes cross-talk or normalizes impedance in the system. Referring to FIG. 6*a*, which shows a pair of flexible conductive elements 55C and 55B in back-to-back relationship, it will be recognized that the flexible insulative covering 60 is comprised of two planar insulative sheets 60A and 60B, each sheet having grooves 62 formed therein, between which the conductive strips 58 are placed. These planar insulative sheets may be made of 3 mil thick polyimide (KAPTON TM) plastic film that are bonded to one another, to the conductive strips 58, and to the semi-rigid supporting sheet 63, by a chemical adhesive. The semi-rigid supporting sheet 63 is preferably a conductive sheet. This conductive sheet may be made of electrical tough pitch (ETP) copper having a thickness of 1.4 mil. After the flexible conductive element 55 has been constructed in the manner indicated, the pair of carrier strips that are connected to either set of flexible leads may be removed.

Figure 3B:
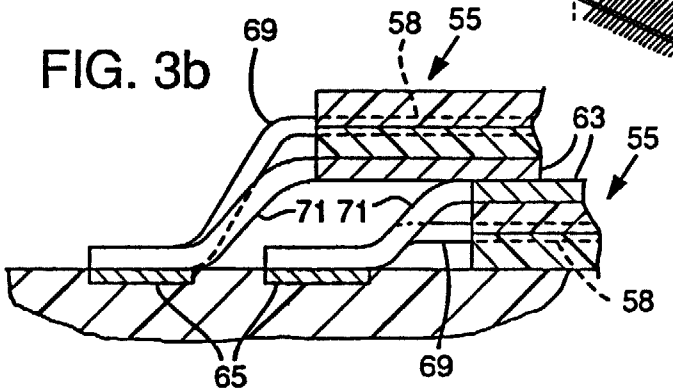
FIG. 3*b* is an enlarged view of a pair of indexed trace connections of FIG. 3*a*.

The function of the semi-rigid conductive sheet 63, having reference lead ends 71, is best appreciated upon consideration of the flexible conductive element 55 in operation between a high-density group of coplanar leads and a high-density arrangement of narrower indexed conductors 65. Refer to FIG. 3*a*. Without a supporting sheet 63 it is likely that the imposition of transverse forces on the flexible conductive element 55 (caused, for example, by dropped external objects or user mishandling) would break the very thin (1.4 mil) conductive strips contained in the flexible conductive element. Refer to FIGS. 5. Adding a semi-rigid conductive sheet 63 to the flexible conductive element 55 prevents this type of damage. In addition to these large-scale transverse forces, however, there are also small-scale longitudinal forces transmitted from the coplanar lead groups as the electrical assembly connector 10 is mated to the mating connector assembly 15. The semi-rigid supporting sheet 63 should curve slightly to accommodate these forces rather than directly transmitting these forces to the very thin flexible lead ends 69 extending from the second end 67 of each flexible conductive element 55. To further prevent transmission of such forces to the narrow flexible lead ends 69, the semi-rigid conductive sheet 63 includes reference lead ends 71 that are interposed between the narrow flexible lead ends (see FIGS. 5). Referring to FIG. 3*b*, these reference lead ends 71 fix the position of the semi-rigid conductive sheet 63 in relation to the coplanar conductive traces 65 so that the conductive sheet 63 serves as a cantilevered supporting base for the narrow conductive strips 58. In a preferred embodiment of the invention, the reference lead ends 71 of the conductive sheet 63, being nominally connected to ground potential, further provide a well-defined electromagnetic region (characteristic impedance) surrounding the conductive strips 58.

Figure 4:
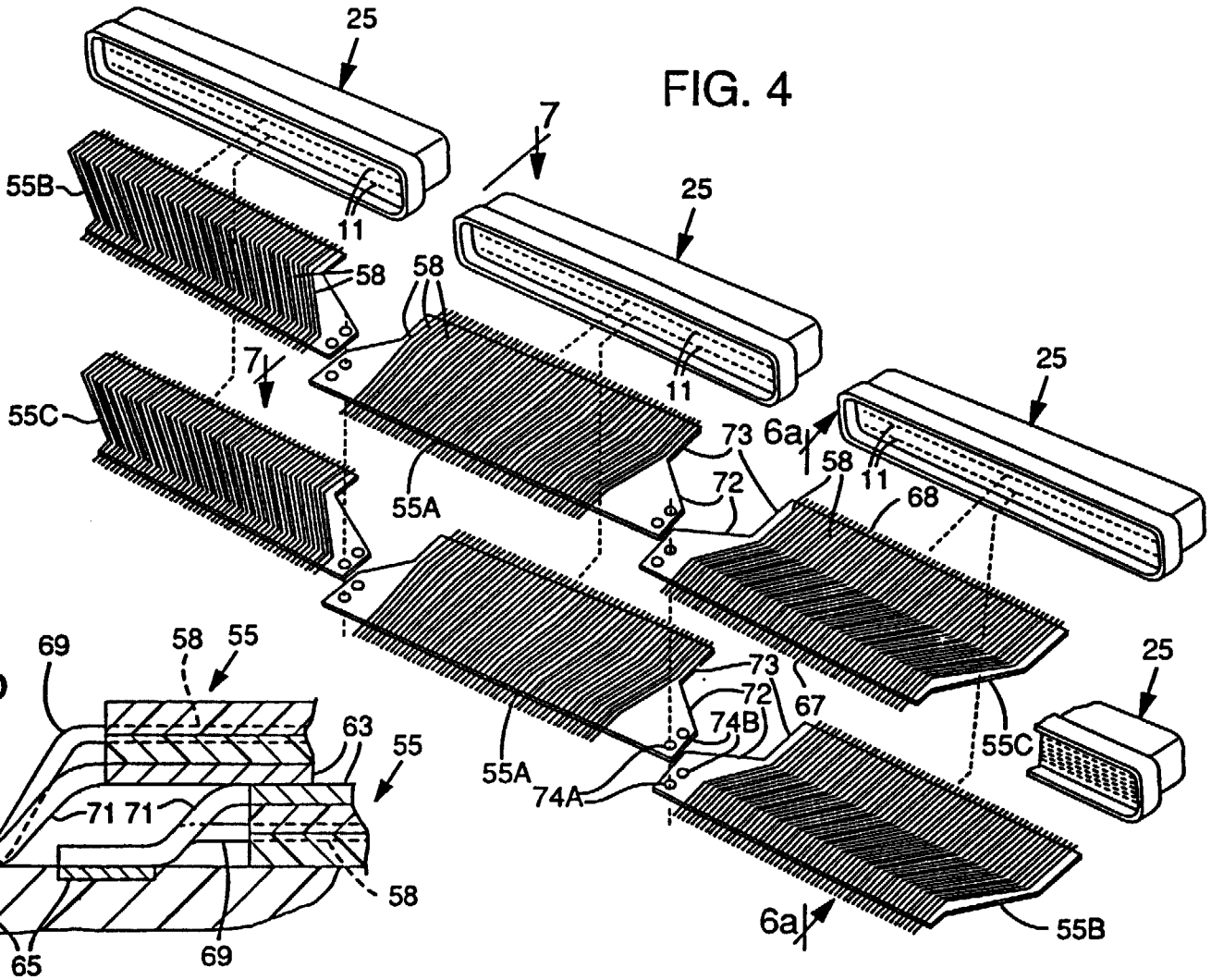
FIG. 4 is an exploded perspective view displaying the arrangement of flexible conductive elements for an exemplary embodiment of the present invention having more than one insulator block.

As best illustrated by FIGS. 4 and 8, a particular electrical connector assembly 10 may include a number of insulator blocks 25 that are arranged in vertical columns and horizontal rows. Referring to FIG. 4, any particular insulator block may have one or more coplanar lead groups 11. In FIG. 3*a*, a specific embodiment is illustrated where connection is made with a double row of conductive traces 65 on either side of a dielectric board 66 through deployment of four flexible conductive elements 55 electrically connected to four coplanar lead groups, with every two coplanar lead groups associated with one individual insulator block 25. To achieve vertical adjoining of the flexible conductive elements 55, each flexible conductive element is provided with an adjoining end portion 72 and a separated end portion 73, each separated end portion containing conductive strips 58 that connect with a particular coplanar connector lead group 11 as indicated by FIG. 4.

Figure 7:
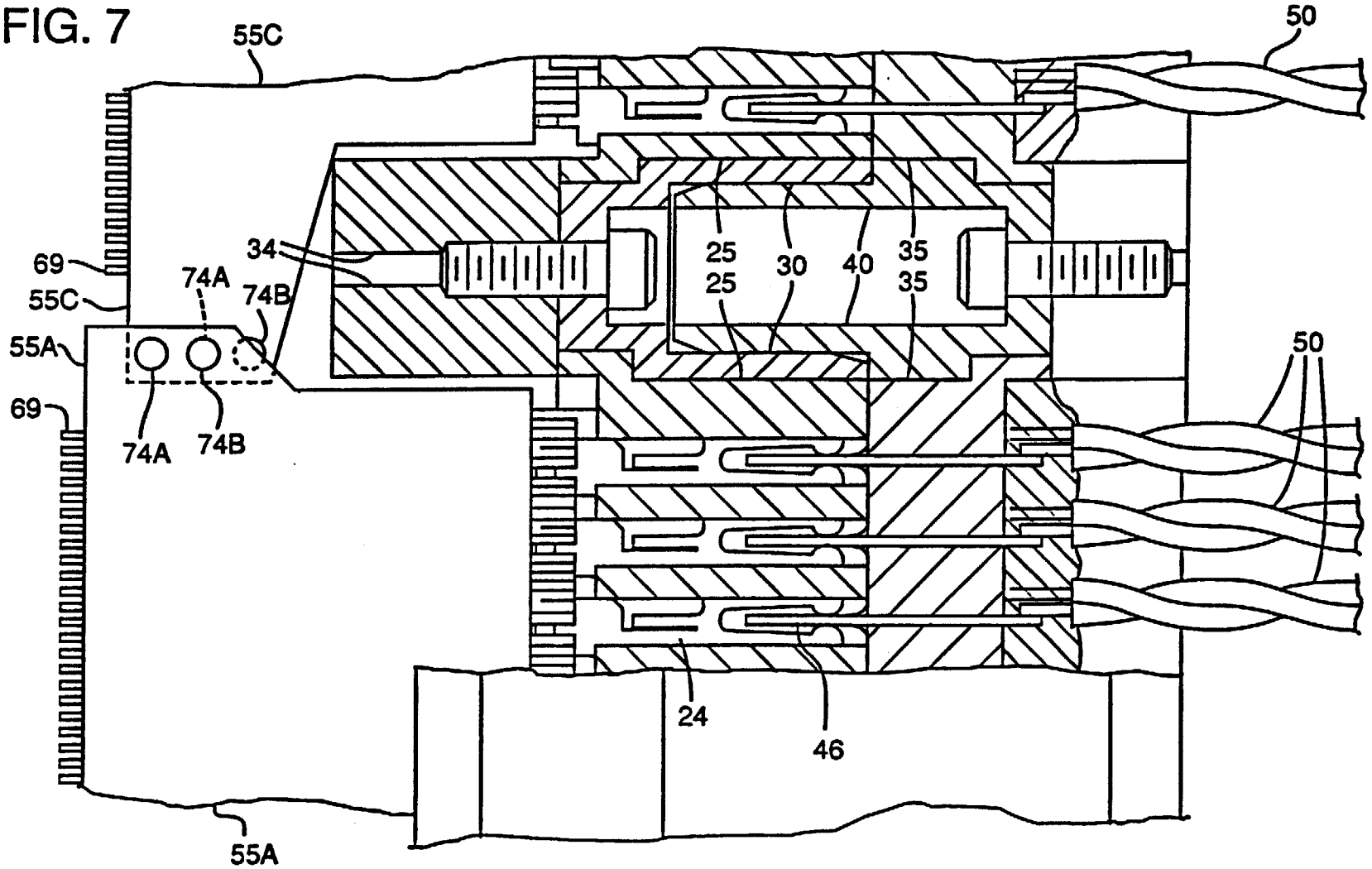
FIG. 7 is an enlarged sectional view, taken along line 7—7 of FIG. 4, including depiction of a frame and associated elements, a mating multiconductor assembly, and interchangeable conductors.

Referring to FIGS. 5*a*, 5*b* and 5*c*, the adjoining end portion 72 of each flexible conductive element is provided with forward alignment holes 74A and rearward alignment holes 74B. Where attachment to a double row of coplanar conductive traces 65 is desired, it is preferable to align the two holes, with the use of a pin-like dowel, so that the rearward alignment holes 74B of the top flexible conductive element are positioned over the forward alignment holes 74A of the bottom flexible conductive element, thereby resulting in a long/short relationship between the top/bottom pair of conductive elements as shown in FIG. 3*b*. This long/short relationship is also depicted in FIG. 7 between two flexible conductive elements adjoined in side-by-side relationship as well as top/bottom relationship. Once the respective flexible lead ends 69 of the adjoined elements 55 are soldered to the appropriate row of coplanar conductive traces 65, proper alignment will be preserved between these elements upon removal of the dowels.

Figure 6B:
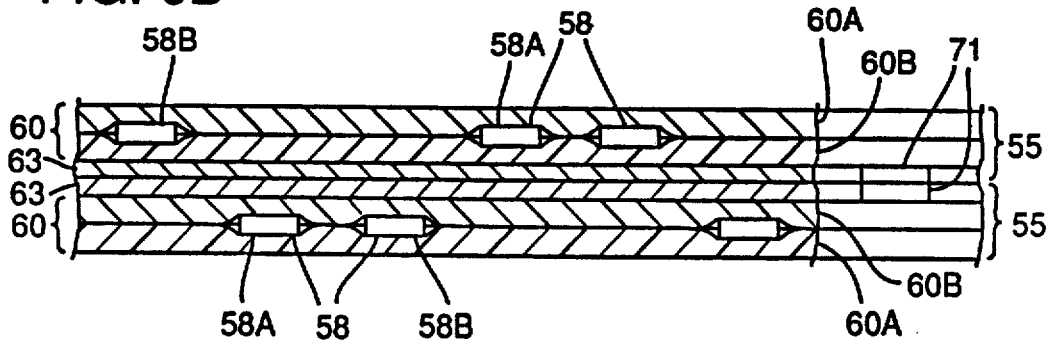
FIG. 6*b* is a corresponding enlarged sectional view of a second embodiment of two joined flexible conductive elements in accordance with the present invention.

When the flexible conductive elements 55 are adjoined in a long/short relationship, the conductive strips 58 and flexible lead ends 69 of the top element 55 may oppose and extend beyond the conductive strips 58 and flexible lead ends 69 of the bottom element 55. See FIGS. 3*b* and 6*a*. For the specific embodiment shown in FIGS. 3*b* and 6*a*, by having the conductive sheet 63 of the top element extending over the flexible lead ends 69 and reference leads 71 of the bottom element, cross-talk between the respective flexible lead ends is prevented. An alternative embodiment of the invention could utilize flexible conductive elements where the forward alignment holes 74A of the top element are aligned with the forward alignment holes 74A of the bottom element. Here, to prevent cross-talk among the respective flexible lead ends, the conductive strips 58 and flexible lead ends 69 of the top element may be placed in nonoverlapping relationship with the conductive strips 58 and flexible lead ends 69 of the bottom element, as indicated by FIG. 6*b*. With such an approach, the adjoining pair of top and bottom elements would have their respective flexible lead ends converging to a single row of coplanar conductive traces 65 in contrast to the long/short approach which terminates in a double row of coplanar conductive traces.

The individual flexible conductive elements 55 are releasably adjoinable. Referring to FIG. 4, if signal transmission errors are detected, along lines associated with a particular coplanar lead group 11, then the corresponding flexible conductive element 55 may be conveniently removed by cutting through its flexible lead ends 70 at its second end 68 and by desoldering its flexible lead ends 69 at its first end 67 from the coplanar traces on the board. The contact/terminal assemblies of that particular coplanar lead group 11 are then removed from the appropriate insulator block 25 and are disposed of along with the spent flexible conductive element 55. Referring to FIG. 8, if the insulator block 25 also needs servicing, then the appropriate outside keeper 33 and center keeper 34 are unscrewed from frame 30 of the connector assembly 10 so that the spent insulator block 25, along with its related contact/terminal assemblies, may be removed from the assembly and disposed of. A new insulator block 25 is then inserted into the frame 30, new connector/terminal assemblies are inserted into the cavities of the insulator block, and a new flexible element 55 is adjoined against the other elements in the manner described above. As shown in FIG. 3*a*, after reassembly is complete, the new element lies connected between a coplanar row of traces 65 on a computer board and a coplanar series, 18 or 19, of terminal leads. To facilitate serviceability of the insulator blocks, no single flexible conductive element is routed to more than one insulator block.

From FIG. 4, it will be seen that the flexible conductive elements may be adjoined horizontally as well as vertically. A preferred embodiment of the invention relies on flexible conductive elements of three different types: a center type 55A, a left-hand type 55B and a right-hand type 55C. See FIG. 5. Although the specific embodiment shown in FIG. 4 utilizes only one center type element 55A per horizontal row, it will be recognized that any number of center type elements may be employed depending on the particular requirements. FIG. 4 further illustrates that the conductive strips 58 of the two end type of elements, 55B and 55C, converge toward the conductive strips 58 of the center type of conductive element 55A. This provides closer spacing of the respective flexible lead ends 69 so that such ends are connectable to the closely spaced coplanar conductive traces on a single circuit board. To further ensure minimum spacing between the respective flexible lead ends, it will be seen that the adjoining end portions 72 of adjacent flexible conductive elements 55 are positioned in slightly overlapping relationship as shown in FIG. 4. In relation to the serviceability aspect of the invention, any of the three types of flexible conductive elements, 55A, 55B or 55C, may either be used as a top element, or turned over and used as a bottom element. Indeed, as may be seen from FIG. 4, a series of top elements may be turned over to provide a series of bottom elements. This reduces the expenses associated with the manufacture of the flexible conductive elements and ensures an appropriate unit price for this disposable item. As shown in FIGS. 6*a* and 6*b*, adjacent conductive strips 58 may be designated for either signal line use 58A, or reference line use, 58B, where the lines designated for signal use alternate with the lines designated for reference use, thereby minimizing cross-talk at high frequencies.

It will therefore be appreciated that the aforementioned and other desirable objects have been achieved; however, it should be emphasized that the particular embodiment of the invention, which is shown and described herein, is intended as merely illustrative and not as a restrictive of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An electrical connector assembly including a plurality of contacts, detachably engageable with a mating multiconductor assembly, and a plurality of terminals occupying different positions in an imaginary plane defined by a first axis and a second axis mutually perpendicular to each other, said connector assembly comprising:

(a) a series of at least four of said contacts each spaced at a different distance from said second axis along a direction parallel to said first axis, at least some of said contacts being offset from each other by respective distances parallel to said second axis; and (b) a series of at least four of said terminals, each coupled to a respective one of said contacts, having corresponding portions spaced apart at different positions in substantial alignment along an imaginary line which extends parallel to said second axis and which substantially bisects said series of contacts.

2. An electrical connector assembly as recited in claim 1 wherein each of said contacts has a substantially identical predetermined maximum dimension parallel to said second axis, and the spacing between said corresponding portions of said terminals along said imaginary line is smaller than half of said predetermined maximum dimension.

3. An electrical connector assembly as recited in claim 1 wherein each of said contacts has a substantially identical predetermined maximum dimension parallel to said second axis, and the distances by which at least some of said contacts are offset from each other parallel to said second axis are smaller than said predetermined maximum dimension.

4. An electrical connector assembly including a plurality of contacts, detachably engageable with a mating multiconductor assembly, and a plurality of terminals occupying different positions in an imaginary plane defined by a first axis and a second axis mutually perpendicular to each other, said connector assembly comprising:

(a) a series of at least four of said contacts each spaced at a different distance from said second axis along a direction parallel to said first axis and each having a detachably engageable portion and a coupling portion;

(b) a series of at least four of said terminals each having a lead portion and a neck portion, where each respective neck portion electrically connects to the coupling portion of a respective contact thereby forming a contact/terminal assembly, the respective lead portions having ends substantially in alignment with one another so as to define an imaginary line perpendicular to said first axis, and where there exist pairs of said contact/terminal assemblies, one member from each respective pair of assemblies exhibiting at 180° translational symmetry with respect to the other member of said respective pair about a predetermined axis perpendicular to said plane and intersecting said imaginary line at a predetermined point.

5. An electrical connector assembly as recited in claim 4 wherein said lead portions are positioned at equal intervals along said imaginary line.

6. An electrical connector assembly as recited in claim 4 wherein each of said contacts represents one leg of an "L" extending along said second axis and the neck portion of the respective terminal connected thereto is substantially straight and represents a second leg of said "L" extending along said first axis.

7. An electrical connector assembly as recited in claim 4 wherein said contacts are forks having two opposed tines of equal size.

8. An electrical connector assembly as recited in claim 4 wherein there are two different types of said contact/terminal assembly, one type of contact/terminal assembly having its lead portion offset from its detachably engageable portion by respective first and second distances parallel to said first and second axes, respectively, and the other type having its lead portion offset from its detachably engageable portion by third and fourth distances parallel to said first and second axes, respectively, said first distance being greater than said third distance and said second distance being smaller than said fourth distance.

9. An electrical connector assembly as recited in claim 4, further comprising second ones of said series of contacts and series of terminals, respectively, spaced from the respective first ones of said series along said first axis, and respective conductors connected to said respective first and second series of terminals, said conductors converging to a single planar array of conductors parallel to said imaginary line.

10. An electrical connector assembly as recited in claim 4 wherein each contact closest in position to a respective other contact is offset from that other contact by a respective distance parallel to said second axis.

11. An electrical connector assembly, as recited in claim 4, further comprising an insulator block having at least four cavities passing from a first side to a second side of said block, wherein each of said cavities substantially contains one of said contacts so that the coupling portion thereof is adjacent said first side and the detachably engageable portion thereof is positioned inside the cavity toward said second side, each of said cavities having inwardly converging beveled walls at said second side.

12. An electrical connector assembly, as recited in claim 11, each of said cavities including a delatch channel having one end open at said second side and a second opposing end defining an interior shoulder in the cavity, and each of said contacts includes a resilient latching tang that projects transversely from the contact into one of said delatch channels and abuts the interior shoulder thereof so that the contact is retained in the cavity.

13. An electrical connector assembly, including a plurality of contacts, detachably engageable with a mating multiconductor assembly, and a plurality of terminals occupying different positions in an imaginary plane defined by a first axis and a second axis mutually perpendicular to each other, said connector assembly comprising:

(a) series of at least four of said contacts each spaced at a different distance from said second axis along a direction parallel to said first axis, each having a detachably engageable portion, and each having a substantially identical predetermined maximum dimension parallel to said second axis;

(b) a series of at least four of said terminals each including a neck portion and a lead portion, wherein each respective neck portion electrically couples with a respective contact, said lead portions being substantially coplanar and each including a juncture that is shared with a respective neck portion, said junctures being positioned in spaced-apart relationship along a direction parallel to said second axis so that the spacing between any two adjacent ones of said junctures is smaller than said predetermined maximum dimension, each one of said junctures having a first offset along a direction parallel to said first axis and a second offset along a direction parallel to said second axis with respect to the detachably engageable portion of its corresponding respective contact, and said first and second offsets having varying lengths so that the respective first offsets decrease in length as the corresponding second offsets increase in length.

14. An electrical connector assembly as recited in claim 13 wherein the spacing between adjacent ones of said contacts along a direction parallel to said second axis is smaller than said predetermined maximum dimension.

15. An electrical connector assembly as recited in claim 13 wherein said junctures are spaced at equal intervals along said direction parallel to said second axis.

16. An electrical connector assembly as recited in claim 13 wherein there exists at least one pair of adjacent ones of said junctures having respective second offsets that are oppositely directed.

17. An electrical connector assembly as recited in claim 13 wherein said connectors are arranged in a top group and a bottom group so that the respective first offsets of said top group are directionally opposite to the respective first offsets of said bottom group.

18. An electrical connector assembly as recited in claim 13 wherein said junctures are arranged in a first sequence and a second sequence, said first sequence preceeding said second sequence, all of said junctures in said first sequence having first offsets extending in a first direction, all of said junctures in said second sequence having first offsets extending in a second direction, wherein for every individual juncture in said first sequence there is a corresponding juncture in said second sequence having first and second offsets equal in length, but directionally opposite, to the first and second offsets of said individual juncture in said first sequence.

19. An electrical connector assembly as recited in claim 13 wherein each of said contacts represents one leg of an "L" extending along said second axis where the respective terminal connected thereto is substantially straight and represents a second leg of said "L" extending along said first axis and where the two respective terminals having the shortest second legs are positioned adjacent each other with their respective first and second legs being oppositely directed.

20. An electrical connector assembly detachably engageable with a mating multiconductor assembly and engageable with a plurality of coplanar conductive traces on a dielectric base, said connector assembly comprising:

(a) an insulator block having a plurality of cavities;

(b) a plurality of discrete conductive contacts contained in the cavities of said insulator block;

(c) a semi-flexible conductive element comprising a plurality of generally planar conductive strips, a flexible insulative covering, a semi-rigid supporting sheet, a first end and a second end, said conductive strips being encased within said flexible insulative covering and each including an opposed pair of flexible lead ends extending beyond the first and second ends of said flexible conductive element, each of said flexible lead ends which extends beyond the first and being electrically connectable with a respective one of said coplanar conductive traces and each of said flexible lead ends which extends beyond the second end being electrically connectable with a respective one of said conductive contacts, said flexible lead ends at said first end being narrower than said flexible lead ends at said second end, said flexible insulative covering being mounted on said semi-rigid supporting sheet so as to provide said semi-flexible conductive element with resiliency sufficient to accommodate the movement of said conductive contacts within said cavities but insufficient to accommodate greater than ninety degree bends along any portion of said semi-flexible conductive element.

21. An electrical connector assembly as recited in claim 20 wherein said planar conductive strips are substantially uniformly spaced from one another.

22. An electrical connector assembly as recited in claim 20 wherein said semi-rigid supporting sheet comprises a semi-rigid conductive sheet.

23. An electrical connector assembly as recited in claim 20 wherein said flexible insulative covering is comprised of polyimide.

24. An electrical connector assembly, detachably engageable with a mating multiconductor assembly and engageable with a plurality of coplanar conductive traces on a planar dielectric base, an imaginary plane being defined by a first axis and a second axis mutually perpendicular to each other, said second axis being parallel to said base, said connector assembly comprising:

(a) an insulator block having a plurality of cavities;

(b) at least a pair of discrete conductive contact groups each containable in separate respective cavities of said insulator block, said conductive contact groups including respective coplanar contact lead groups, said coplanar contact lead groups being arranged in respective planes parallel to said second axis and spaced apart from each other along a direction parallel to said first axis; and (c) at least a pair of flexible planar conductive elements, each respective element including a plurality of insulated, generally planar, conductive strips, an adjoining end portion adjoinable to the corresponding adjoining end portion of the other element, and a separated end portion, movable relative to the corresponding separated end portion of the other element, the conductive strips of an individual element each having an opposed pair of flexible lead ends extending from the adjoining end portion and separated end portion, respectively, of that element, said elements being positionable in a substantially face-to-face relationship facing along a direction parallel to said first axis, the respective adjoining end portions of said elements being adjoinable with one another in said face-to-face relationship so that the flexible lead ends extending from the respective adjoining end portions converge along said direction parallel to said first axis to a single planar array that is electrically engageable with said plurality of coplanar conductive trances, the respective separated end portions of said elements each being alignable with a respective coplanar contact lead group so that the flexible lead ends extending from one separated end portion are in spaced-apart relationship from the flexible lead ends of the other separated end portion along said direction parallel to said first axis so that they can each electrically engage a respective one of said coplanar contact lead groups.

25. An electrical connector assembly as recited in claim 24 wherein the flexible lead ends extending from the adjoining end portions of one of said pair of elements extend beyond the flexible lead ends extending from the adjoining end portion of the other of said pair of elements in a direction parallel to said primary conducting axis such that the flexible lead ends extending from the adjoining end portions of both of said elements converge to a single coplanar array.

26. An electrical connector assembly as recited in claim 24 wherein each of said flexible conductive elements further includes a semi-rigid conductive sheet that provides support and shielding along one face of said elements, and wherein at least one pair of said elements are releasably adjoined together at their respective adjoining end portions such that their respective semi-rigid conductive sheets are in substantially sandwiched relationship between adjoining faces of their respective adjoining end portions.

27. An electrical connector assembly as recited in claim 26 wherein the flexible lead ends extending from the adjoining end portion of one of said pair of elements are in nonoverlapping staggered relationship with the flexible lead ends extending from the adjoining end portion of the other of said pair of elements and wherein the flexible lead ends from the adjoining end portions of said pair of elements all converge to a single coplanar array.

28. An electrical connector assembly detachably engageable with a mating multiconductor assembly and engageable with a plurality of coplanar conductive traces on a planar dielectric base, an imaginary plane being defined by a first axis and a second axis mutually perpendicular to each other, said second axis being parallel to said base, said connector assembly comprising:

(a) at least a pair of insulator blocks mounted detachably from one another in spaced-apart, side-by-side relationship along a direction parallel to said second axis;

(b) at least a pair of discrete conductive contact groups each containable in a respective one of said insulator blocks, said conductive contact groups including respective coplanar contact lead groups spaced apart along said direction parallel to said second axis;

(c) at least a pair of flexible planar conductive elements, each respective element including a plurality of insulated, generally planar, conductive strips, an adjoining end portion adjoinable to the corresponding adjoining end portion of the other element, and a separated end portion movable relative to the corresponding separated end portion of the other element, the conductive strips of an individual element each having an opposed pair of flexible lead ends extending from the adjoining end portion and separated end portion, respectively, of that element, said elements being positionable in a substantially side-by-side relationship along said direction parallel to said second axis, the respective adjoining end portions of said elements being adjoinable with one another in said side-by-side relationship so that the flexible lead ends extending from each adjoining end portion are aligned in a single planar array that is electrically engageable with said plurality of coplanar traces, the respective separated end portions of said elements each being alignable with a respective insulator block so that the flexible lead ends extending from one separated end portion are in spaced-apart, side-by-side relationship with respect to the flexible lead ends of the other separated end portion along said direction parallel to said second axis so that they can each engage a respective one of said coplanar contact lead groups.

29. An electrical connector assembly as recited in claim 28 wherein each of said flexible conductive elements further includes a semi-rigid conductive sheet that is attached to a face of that respective element for support and shielding, and wherein the separated end portions of said elements are spaced-apart along said direction and .the adjoining end portions of said elements are in partially overlapping relationship along said direction.

30. An electrical connector assembly as recited in claim 9 said flexible conductive elements include a right-hand type, a left-hand type, and at least one center type, wherein the conductive strips of said right-hand type, and said left-hand type, respectively, converge towards the conductive strips of said center type.

* * * * *

UNITED STATES PATENT AND TRADEMARK OFFICE

CERTIFICATE OF CORRECTION

PATENT NO. : 4,993,969

DATED : February 19, 1991

INVENTOR(S) : Michael K. Cabourne

It is certified that error appears in the above-indentified patent and that said Letters Patent is hereby corrected as shown below:

Col. 2, line 64 Change "performance," to -- performance.--

Col. 2, line 65 Change "aproach" to --approach--

Col. 3, line 56 Change "foorprint" to --footprint--

Col. 4, line 7 Change "contact /terminal" to --contact/terminal--

Col. 4, lines 51-52 After "sequence," delete "-."

Col. 8, lines 29-30 Change "particula-r. the" to --particular, the--

Col. 8, line 35 After "1" insert --and--

Col. 8, line 41 After "specific" delete "r"--

Col. 8, line 65 Change "neek" to --neck--

Col. 10, line 41 Change "ufficient" to --sufficient--

Col. 10, line 54 Change "accord" to --accordance--

Col. 11, line 19 Change "Elecrical" to --Electrical--

Col. 11, line 62 Change "FIGS. 5" to --FIGS. 5a-c--

Col. 12, line 9 Change "FIGS. 5" to --FIGS. 5a-c--

Col. 16, line 13 After "(a)" insert --a--

Col. 16, line 60 Change "preceeding" to --preceding--

UNITED STATES PATENT AND TRADEMARK OFFICE

CERTIFICATE OF CORRECTION

PATENT NO. : 4,993,969

DATED : February 19, 1991

INVENTOR(S) : Michael K. Cabourne

It is certified that error appears in the above-indentified patent and that said Letters Patent is hereby corrected as shown below:

Col. 17, line 27 Change "and" to --end--

Col. 18, line 21 Change "trances" to --traces--

Col. 18, line 55 Change "elements" to --elements,--

Col. 20, line 18 Change "and . the" to --and the--

Col. 20, line 22 After "claim 9" insert --wherein--

Signed and Sealed this

Fourth Day of July, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,993,969

DATED : February 19, 1991

INVENTOR(S) : Michael K. Cabourne

It is certified that error appears in the above-indentified patent and that said Letters Patent is hereby corrected as shown below:

Column 20, line 22, change "claim 9 wherein" to --claim 29 wherein--.

Signed and Sealed this

Second Day of April, 1996

Bruce Lehman

*Attest:*

BRUCE LEHMAN

*Attesting Officer*

*Commissioner of Patents and Trademarks*